US006310551B1

(12) United States Patent
Croft

(10) Patent No.: US 6,310,551 B1
(45) Date of Patent: Oct. 30, 2001

(54) ALPINE RESCUE ALERT ASSEMBLY

(76) Inventor: David G. Croft, 1475 S. St. Paul, Denver, CO (US) 80210

( * ) Notice: Subject to any disclaimer, the term of this patent is extended or adjusted under 35 U.S.C. 154(b) by 0 days.

(21) Appl. No.: 09/422,807

(22) Filed: Oct. 21, 1999

(51) Int. Cl.[7] ..... G08B 23/00

(52) U.S. Cl. ..... 340/573.1; 340/332; 340/384.1; 280/18; 280/19; 280/19.1; 280/20; 116/51; 116/52; 116/53

(58) Field of Search ..... 340/573.1, 332, 340/384.1; 280/18, 19, 19.1, 20, 21.1, 24; 116/51, 52, 53, 54

(56) References Cited

U.S. PATENT DOCUMENTS 3,104,116 * 9/1963 Knight, Jr. ..... 280/18
6,112,443 * 9/2000 Stubbs ..... 40/591

* cited by examiner

*Primary Examiner*—Julie Lieu
(74) *Attorney, Agent, or Firm*—Edwin H. Cradtree; Ramon L. Pizarro; Donald W. Margolis

(57) ABSTRACT

An alpine rescue alert assembly operated by a ski patrol member. The rescue alert assembly adapted for mounting between a pair of toboggan handles pivotally attached to the front of a toboggan. The toboggan used for carrying an injured skier. The alert assembly includes a battery received in a battery tray attached to a side of one of the handles. The assembly also includes a pole mounting base. The pole mounting base rotatably mounted on a pivot pin ring. The pivot pin ring is attached to a ring bracket mounted on and expending upwardly from an assembly brace. A lower end of a pivot pole is releasably attached to the pole mounting base. The pole mounting base allows the pole to be raised from a lowered horizontal position upwardly to a vertical position when the alert assembly is in use. An upper end of the pivot pole includes a strobe light and a siren mounted thereon. The strobe light and siren include electrical wiring connected to the battery. Also, an "on" and "off" switch is mounted next to a handle grip attached to one end of the handles. The switch includes electrical wiring connected to the battery. When the switch is turned "on", the strobe light and siren provide a warning to nearby skiers to stay clear of the ski patrol member and injured skier so that the skier can be safely transported for receiving medical care.

17 Claims, 2 Drawing Sheets

ALPINE RESCUE ALERT ASSEMBLY

BACKGROUND OF THE INVENTION (a) Field of the Invention

This invention relates to an alpine rescue alert assembly used on a transportation vehicle and particularly, but not by way of limitation, to a rescue alert assembly mounted on a pair of handles attached to the front of a toboggan used in carrying an injured skier.

(b) Discussion of Prior Art

In U.S. Pat. No. 4,389,066 to Weir et al. a rescue unit is disclosed. The rescue unit is attached to skis and pulled by a snow mobile. The rescue unit is shown with an antenna and antenna light powered by a battery. In U.S. Pat. No. 3,104,116 to Knight, Jr. a rescue toboggan is described. A light is mounted on a nose section of the toboggan. In U.S. Pat. No. 5,306,026 to Jesse and U.S. Pat. No. 5,242,176 to Hendrickson two different types of rescue toboggans and sleds are illustrated.

None of the above mentioned patents disclosed the combination of structure, function and advantages making up the unique alpine rescue alert assembly described herein. The rescue alert assembly adapted for mounting on the handles of a toboggan and operated by a ski patrol member.

SUMMARY OF THE INVENTION

In view of the foregoing, it is a primary object of the subject invention is to provide a visual and an audio alert by a ski patrol member to nearby skiers when transporting the injured skier. The visual and an audio alert giving warning to other skiers to stay clear of a ski patrol rescue team when transporting an injured skier downhill.

Another object of the invention is the assembly is readily adaptable for mounting on an existing pair of toboggan handles. The toboggan used in transporting injured skiers. Also, the assembly can be used on snowmobiles, snow tractors and other related equipment used in the ski industry.

Still another object of the invention is the assembly includes its own electrical power supply along with a strobe light and siren for providing the visual and audio alert.

The alpine rescue alert assembly is adapted for mounting between a pair of toboggan handles having a first end and a second end. The first end of the handles include handle grips. The second end of the handles are pivotally attached to the front of a toboggan.

The rescue alert assembly includes a 12 volt battery power source received on top of a battery tray. The battery tray is attached to the side of one of the toboggan handles.

A pole mounting base with a pivot bolt extending outwardly therefrom is attached to a first pivot pin ring. The first pivot pin ring includes a plurality of pin holes therein. The first pivot pin is disposed next to a similar second pivot pin ring. The second pivot pin ring includes a plurality of pin holes therein. The pin holes in the first and second pivot pin rings are used for receiving a pivot pin. The second pivot pin ring is attached to a ring bracket. The pivot bolt is received through the first and second pivot pin rings and is attached to the ring bracket. The ring bracket is mounted on and extends upwardly from an assembly brace. Opposite ends of the assembly brace are attached to two cross braces. Opposite ends of the two cross braces are attached a portion of the toboggan handles.

A lower end of a pivot pole is releasably attached inside an annular opening in a top of the pole mounting base. The pole mounting base and the first pivot pin ring rotate next to the second pivot pin ring. The rotation of the pole mounting base allows the pole to be raised from a lowered horizontal position upwardly to a vertical position or any other angle from the horizontal, when the alert assembly is in use. The pivot pole may be expandable, for example from 3 feet to 5 feet, for extending it's length when in use.

An upper end of the pivot pole includes a strobe light and a siren. The strobe light and siren include electrical wiring connected to the battery power source. Also, an "on" and "off" switch is mounted next to one of the hand grips on the first end of one of the handles. The switch includes electrical wiring connected to the battery power source. When the switch is turned "on", the strobe light and siren provide a warning to nearby skiers to stay clear of the ski patrol member and injured skier so that the skier can be safely transported downhill for receiving medical care.

These and other objects of the present invention will become apparent to those familiar with rescue equipment and particularly transportation equipment used in the handling of injured skiers when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figures 1, 2:
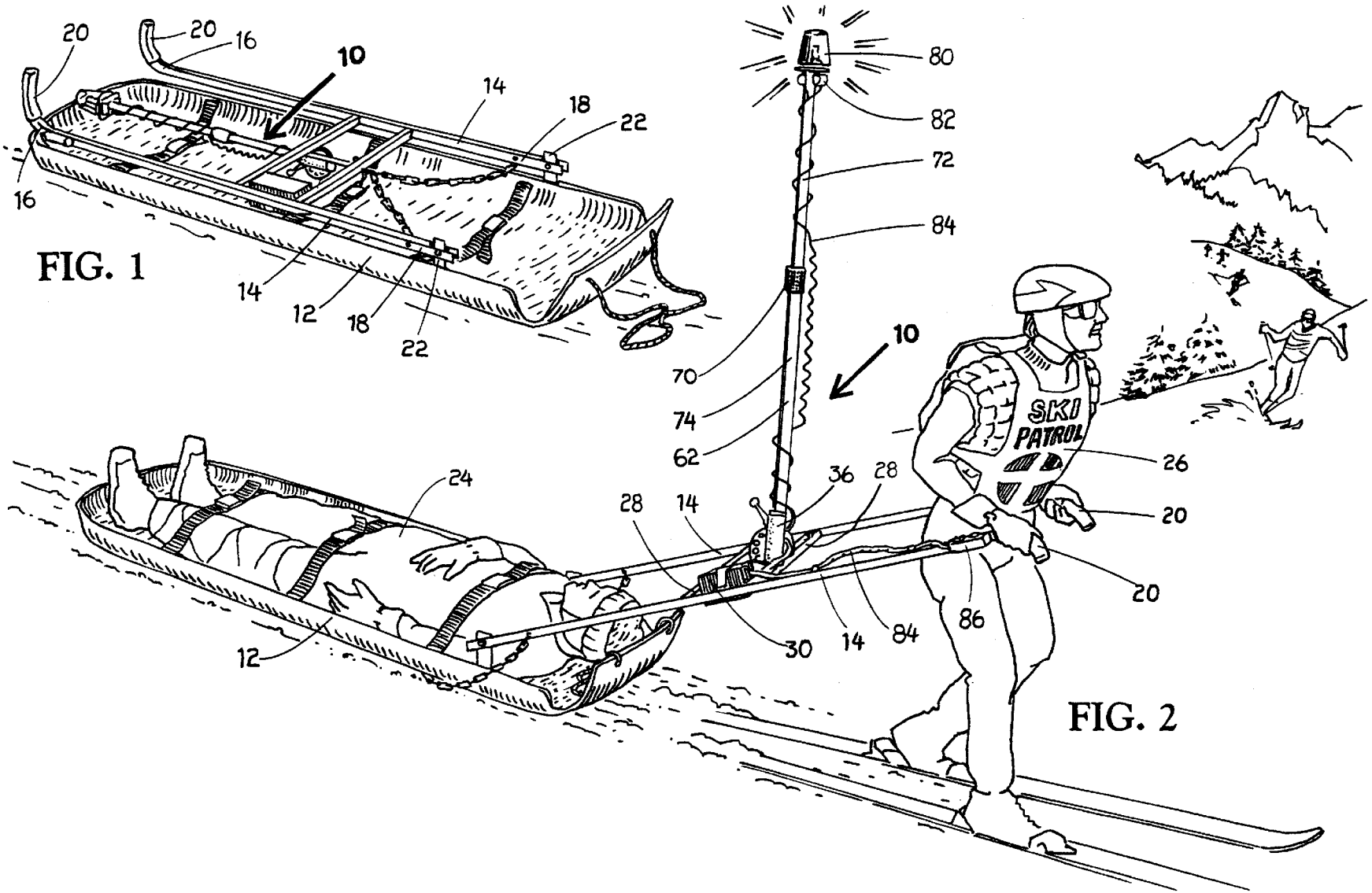
FIG. 1 is a perspective view of the alpine rescue alert assembly in a folded stored position on top of a toboggan. The assembly is mounted between parallel toboggan handles pivotally mounted on the front of the toboggan.
FIG. 2 another perspective view of the alpine rescue alert assembly in an unfolded position extending upwardly from the toboggan handles and in operation. The toboggan is shown carrying an injured skier with a ski patrol member guiding the toboggan downhill.

In FIG. 1, a perspective view of the alpine rescue alert assembly is illustrated and having general reference numeral 10. The alert assembly 10 is shown in a lowered and folded stored position on top of a toboggan 12. The assembly 10 is mounted between parallel toboggan handles 14 having a first end 16 and a second end 18. The first end 16 of the handles 14 include handle grips 20. The second end 18 of the handles 14 are pivotally mounted on handle mounting brackets 22 mounted on the front of the toboggan 12.

In FIG. 2, another perspective view of the alpine rescue alert assembly 10 is illustrated in an unfolded position extending upwardly from the toboggan handles 14 and in operation. The toboggan 12 is shown carrying an injured skier 24 with a ski patrol member 26 gripping the hand grips 20 and guiding the toboggan 12 downhill.

Figure 3:
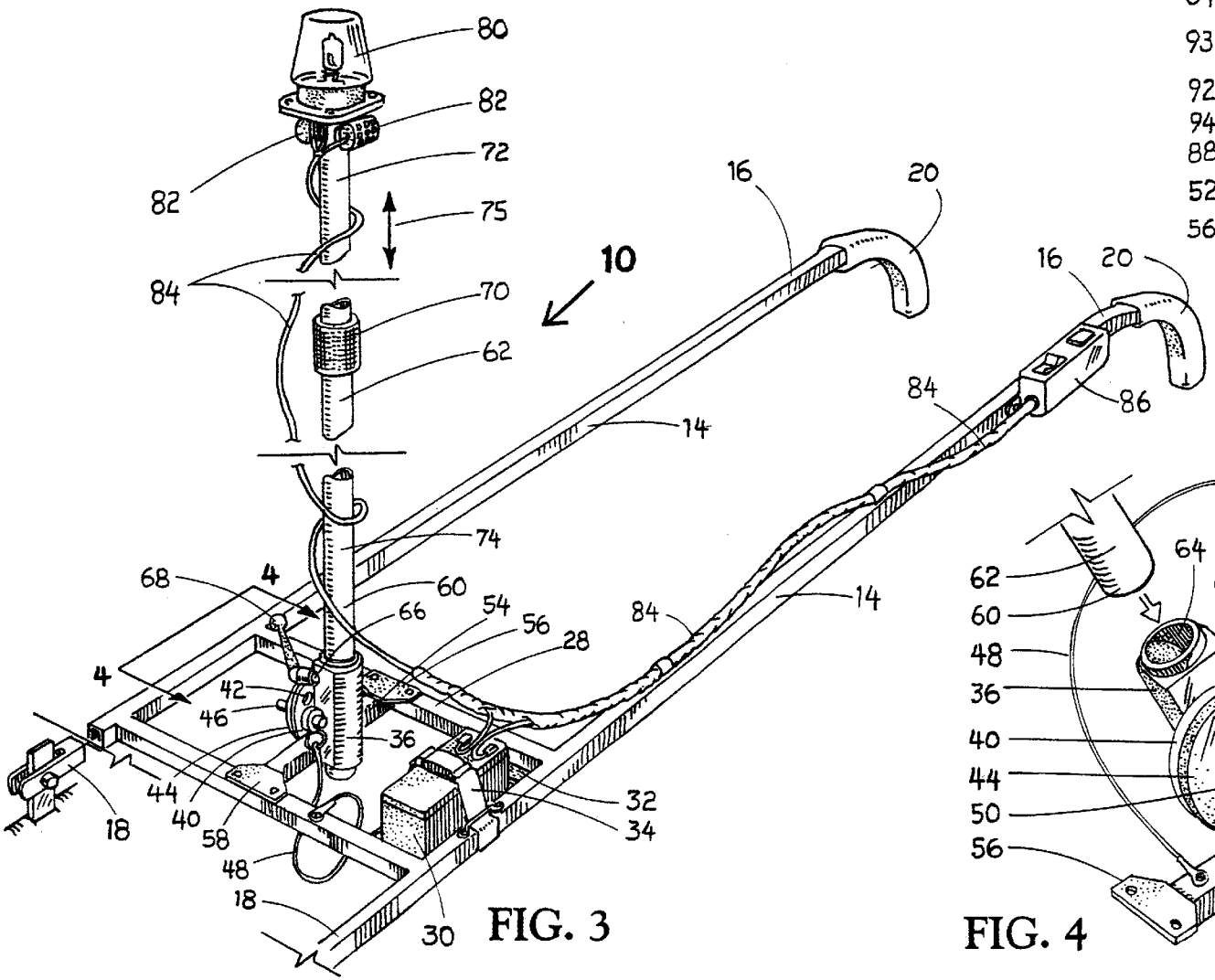
FIG. 3 is an enlarged perspective view of the alert assembly with the assembly mounted on cross braces with the cross braces secured at opposite ends to the handles of the toboggan. The expandable pole is shown in an upright vertical position.

In FIG. 3, an enlarged perspective view of the alert assembly 10 is shown and illustrating the various components making up the assembly. The assembly 10 is mounted on a pair of cross braces 28 with the cross braces 28 secured at opposite ends to a portion of the handles 14 of the toboggan 12.

The rescue alert assembly 10 includes a 12 volt DC battery 30 or similar electrical power source received on top of a battery tray 32 and secured thereto using a battery housing strap 34. The battery tray 32 is attached to the side of one of the toboggan handles 14.

Figure 4:
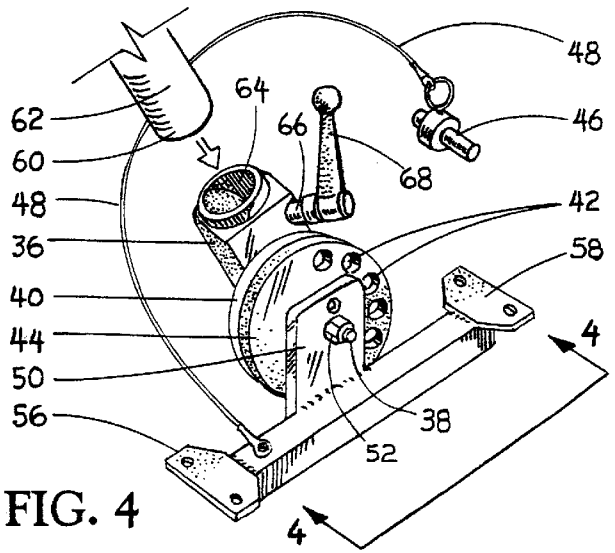
FIG. 4 is an enlarged perspective view of the alert assembly taken along lines 4—4 shown in FIG. 3. The view shows in detail the pole mounting base, the first and second pivot pin rings, the pivot pin an the assembly brace.

A pole mounting base 36, with a pivot bolt 38 extending outwardly therefrom, is attached to a first pivot pin ring 40. A threaded end of the pivot bolt 38 is shown in FIG. 4. The first pivot pin ring 40 includes a plurality of pin holes 42 therein. The first pivot pin ring 40 is disposed next to a similar second pivot pin ring 44. The second pivot pin ring 44 also includes a plurality of pin holes 42 therein. The pin holes 42 in the first and second pivot pin rings 40 and 44 are used for receiving a pivot pin 46 therein. The pivot pin 46 inserted in the pin holes when the pin holes 42 of the first pivot pin ring 40 are indexed with the pin holes 42 in the second pivot pin ring 44. The pivot pin 46 is attached to one end of a pivot pin wire 48. The pivot pin wire 48 prevents the pivot pin 46 from becoming lose with removed from the pivot pine holes 44. The second pivot pin ring is attached to a ring bracket 50. The pivot bolt 38 is received through the first and second pivot pin rings 40 and 44 and the ring bracket 50 and secured to a threaded nut 52 attached to the side of ring bracket 50. The ring bracket 50 is mounted on and extends upwardly from an assembly brace 54. One end 56 and an opposite end 58 of the assembly brace 54 are attached to the two cross braces 28. An opposite end of the pivot pin wire 48 is secured to a portion of the assembly brace 54.

In FIG. 3, a lower end 60 of a pivot pole 62 is releasably attached inside an annular opening 64 in a top of the pole mounting base 36. The annular opening 64 can be seen in FIG. 4. The pivot pole 62 is secured in the opening 64 using a threaded bolt 66 with handle 68. The bolt 66 is received in a side of the base 36 for engaging a portion of the lower end 60 of the pole 62 when it is received inside the opening 64. When the pivot pin 46 is removed from the pin holes 42, the pole mounting base 36 and the first pivot pin ring are free to rotate next to the second pivot pin ring 44 for allowing the pole 62 to be raised from a lowered horizontal position, as shown in FIG. 1, upwardly to a vertical position, as shown in FIGS. 2 and 3, when the alert assembly 10 is in use. Obviously, the pin holes 42 allow the pole 62 to be adjusted to the vertical or any other desired angle depending on the angle of the handles 14 with the slope of snow packed ground surface. The pivot pin 46 is reinserted into the pin holes 42 when the pin holes are properly indexed between the first and second pivot pin rings 40 and 44.

The lower end 60 of the pivot pole 62 is pointed. When the pole 62 is removed from the pole mounting bracket 36, the pointed lower end 60 can be driven into the snow next to or at distance from the toboggan 12. This feature allows the assembly 10 to be placed at a distance from the toboggan 12, should an injured skier be hurt in a tree area next to a ski run or in a remote or steep area of a ski run and the pivot pole 62 with strobe light 80 and siren 82 needs to be placed where it can be seen and heard by others. In this example, additional electrical wiring 84 would be required to allow the pivot pole 62 to be placed 5 to 10 feet or greater from the power source on the toboggan 12.

The pivot pole 62 may be telescoping and expandable, for example from 3 feet to 5 feet, for extending it's length when in use. The length of the pole 62 is extended when loosing a threaded pole connector 70 and moving an upper portion 72, which is slidably received in a lower portion 74, outwardly from the lower portion 74 of the pole 62. When the upper portion 72 of the pole 62 is completely extended, the connector 70 is again tightened. Arrow 75 indicates the movement, up and down, of the upper portion 72 of the pole 62.

An upper end 78 of the pivot pole 62 includes a visual strobe light 80 and an audio siren 82. The strobe light 80 and siren 82 are connected to electrical wiring 84 connected to the battery 30. Also, an "on" and "off" switch 86 is mounted next to one of the hand grips 20 on the first end 16 of one of the handles 14. The switch 86 is also connected to the electrical wiring 84 connected to the battery 30. When the switch 86 is turned "on", the strobe light 80 and siren 82 provide a warning to nearby skiers to stay clear of the ski patrol member 26 and injured skier 24 so that the skier can be safely transported downhill for receiving medical care.

It should be noted, the lower end 60 of the pivot pole 62 is pointed. When the pole 62 is removed from the pole mounting bracket 36, the pointed lower end 60 can be driven into the snow next to or at distance from the toboggan 12. This feature allows the assembly 10 to be placed at a distance from the toboggan 12, should an injured skier be hurt in a tree area next to a ski run or in a remote or steep area of a ski run and the pivot pole 62 with strobe light 80 and siren 82 needs to be placed where it can be seen and heard by other skiers and ski patrol members. In this example, additional electrical wiring 84 would be required to allow the pivot pole 62 to be placed 5 to 10 feet or greater from the power source on the toboggan 12.

In FIG. 4, an enlarged perspective view of the alert assembly 10 is shown taken along lines 4—4 in FIG. 3. In this drawing, the second pivot pin ring 44 is shown secured to the side of the ring bracket 50. Also, in this view, the lower end of the pivot pole 62 is shown removed from the annular opening 64 in the top of the pole mounting base 36. Further, the pivot pin 46 is shown removed from the pin holes 42 so that the first pivot pin ring 40 and pole mounting base 36 can be rotated next to the second pivot pin ring 44.

It should be mentioned, that while the first and second pivot pin rings 40 and 44 with pivot pin 46 are shown in the drawings, various other types of ratchet assemblies, pivot assemblies and the like can be used equally well in raising and lowering the pivot pole 62, with the strobe light and siren, at various angles from the horizontal without departing from the spirit and scope of the invention.

Figure 5:
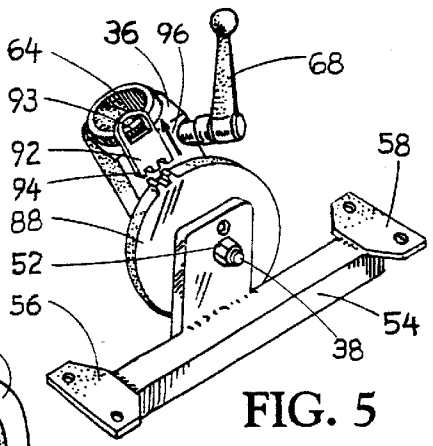
FIG. 5 is an enlarged perspective view the pole mounting base and illustrating another embodiment of a pivot assembly attached to the pole mounting base.

In FIG. 5, another embodiment of a pivot assembly attached to the pole mounting base 36 is shown as an example. In this drawing, the base 36 is rotatably attached to a gear ring housing 88 with a gear ring with gear teeth 90 therearound. Attached to the side of the base 36 is a spring biased gear latch 92 with latch teeth 94. The gear latch 92 is shown in a raised position, as indicated by arrow 96. The gear latch 92 includes a latch hole 93 which can be used for raising the latch 92 as shown. When the gear latch 92 is released, the gear latch 92 and latch teeth 94 are spring biased downwardly. At this time, the latch teeth 94 engage and mesh with the gear teeth 90. The gear latch 92 is designed to cover an opening in the top of the gear ring housing 88 to prevent snow and moisture for getting inside the housing. Obviously, when the gear latch 92 is raised, as shown in this drawing, the latch teeth 94 are disengaged from the gear teeth 90. At this time, the pivot pole 62 can now be raised or lowered on the pole mounting base 36.

Also, it should be mentioned that while the subject alpine rescue alert assembly 10 is described in use with a toboggan, it can be appreciated that the assembly 10 can easily be adapted for use in rescue missions and mounted on a snowmobile, a snow tractor and other related equipment used in helping injured skiers.

While the invention has been shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. An alpine rescue alert assembly operated by a ski patrol member, the rescue alert assembly adapted for mounting between a pair of toboggan handles having a first end and a second end, the first end of the handles include handle grips, the second end of the handles are pivotally attached to the front of the toboggan, the toboggan used for carrying an injured skier, the alert assembly comprising:

an electrical power source adapted for attachment to a side of one of the handles;

a pole mounting base, said pole mounting base pivotally mounted on an assembly brace, said assembly brace adapted for mounting on a portion of the handles;

a pivot pole having a lower end and an upper end, the lower end of said pivot pole attached to said pole mounting base;

visual alert means mounted on the upper end of said pivot pole for alerting nearby skiers, said visual alert means electrically connected to said power source;

audio alert means mounted on the upper end of said pivot pole for alerting nearby skiers, said audio alert means electrically connected to said power source; and an electrical switch connected to said power source, said electrical switch adapted for mounting on a portion of one of the handles, said electrical switch for turning electrical power "on" and "off" to said visual alert means and said audio alert means.

2. The alert assembly as described in claim 1 wherein said visual alert means is a strobe light.

3. The alert assembly as described in claim 1 wherein said audio alert means is a siren.

4. The alert assembly as described in claim 1 wherein said electrical power source is a 12 volt battery.

5. The alert assembly as described in claim 1 wherein said pivot pole is an expandable telescoping pole having an upper portion slidably received inside a lower portion of said pivot pole.

6. The alert assembly as described in claim 1 wherein said pole mounting base includes pivot means for adjusting said pivot pole at various angles from a horizontal position upwardly to a vertical position.

7. An alpine rescue alert assembly operated by a ski patrol member, the rescue alert assembly adapted for mounting between a pair of cross braces disposed between and attached to a pair of toboggan handles, the handles having a first end and a second end, the first end of the handles include handle grips, the second end of the handles are pivotally attached to the front of the toboggan, the toboggan used for used for carrying an injured skier, the alert assembly comprising:

an electrical power source adapted for attachment to a side of one of the handles;

a pole mounting base mounted on an assembly brace, said assembly brace adapted for mounting on the cross braces attached to the handles;

pivot means attached to said pole mounting base, said pivot means for adjusting said pole at various angles from a horizontal position upwardly to a vertical position;

a pivot pole having a lower end and an upper end, the lower end of said pivot pole attached to said pole mounting base;

visual alert means mounted on the upper end of said pivot pole for alerting nearby skiers, said visual alert means electrically connected to said power source;

audio alert means mounted on the upper end of said pivot pole for alerting nearby skiers, said audio alert means electrically connected to said power source; and an electrical switch connected to said power source, said electrical switch adapted for mounting on a portion of one of the handles, said electrical switch for turning electrical power "on" and "off" to said visual alert means and said audio alert means.

8. The alert assembly as described in claim 7 wherein said pivot means includes:

a pivot bolt extending outwardly from said pole mounting base, a first pivot ring having a plurality of pin holes therein, said first pivot ring pivotally mounted on said pivot bolt;

a second pivot pin ring disposed next to said first pivot ring, said second pivot pin ring having a plurality of pin holes therein, said second pivot pin ring attached to a ring bracket mounted on and expanding upwardly from said assembly brace, said second pivot pin ring pivotally mounted on said pivot bolt; and a pivot pin for releasable receipt in a selected pin hole in said first and second pivot rings when the pin holes in said first pivot ring are indexed with the pin holes in said second pivot ring.

9. The alert assembly as described in claim 7 wherein said visual alert means is a strobe light.

10. The alert assembly as described in claim 7 wherein said audio alert means is a siren.

11. An alpine rescue alert assembly operated by a ski patrol member, the rescue alert assembly adapted for mounting between a pair of toboggan handles having a first end and a second end, the first end of the handles include handle grips, the second end of the handles are pivotally attached to the front of the toboggan, the toboggan used for carrying an injured skier, the alert assembly comprising:

an electrical power source adapted for attachment to a side of one of the handles;

a pivot pole having a lower end and an upper end;

a pole mounting base, the lower end of said pivot pole attached to said pole mounting base; said pole mounting base having pivot means mounted on an assembly brace, said assembly brace adapted for mounting on a portion of the handles, said pivot means for adjusting said pivot pole at various angles from a horizontal position upwardly to a vertical position; and visual alert means mounted on the upper end of said pivot pole for alerting nearby skiers, said visual alert means electrically connected to said power source.

12. The alert assembly as described in claim 11 further including an electrical switch connected to said power source, said electrical switch adapted for mounting on the first end of one of the handles, said electrical switch for turning electrical power "on" and "off" to said visual alert means and said audio alert means.

13. The alert assembly as described in claim 11 wherein said visual alert means is a strobe light.

14. The alert assembly as described in claim 11 wherein said audio alert means is a siren.

15. The alert assembly as described in claim 11 wherein said electrical power source is a 12 volt battery.

16. The alert assembly as described in claim 11 wherein said pivot pole is an is an expandable telescoping pole having an upper portion slidably received inside a lower portion of said pivot pole.

17. The alert assembly as described in claim 11 wherein said pole mounting base includes pivot means for adjusting said pivot pole at various angles from a horizontal position upwardly to a vertical position.

* * * * *